US011551648B1

(12) United States Patent
Yang et al.

(10) Patent No.: US 11,551,648 B1
(45) Date of Patent: Jan. 10, 2023

(54) SAXOPHONE HAVING AUXILIARY SIDE BB KEY

(71) Applicant: RELIANCE INTERNATIONAL CORP., Taipei (TW)

(72) Inventors: Sheng-Chieh Yang, Taipei (TW); Ching-Shyan Yen, Taipei (TW); Wei-Ting Chen, Taipei (TW)

(73) Assignee: Reliance International Corp., Taipei (TW)

( * ) Notice: Subject to any disclaimer, the term of this patent is extended or adjusted under 35 U.S.C. 154(b) by 0 days.

(21) Appl. No.: 17/456,716

(22) Filed: Nov. 29, 2021

(30) Foreign Application Priority Data

Nov. 17, 2021 (TW) ..... 110142712

(51) Int. Cl.
*G10D 7/08* (2006.01)

(52) U.S. Cl.
CPC ..... *G10D 7/08* (2013.01)

(58) Field of Classification Search
CPC ..... G10D 7/08; G10D 7/00
See application file for complete search history.

(56) References Cited

U.S. PATENT DOCUMENTS

2004/0031374 A1 2/2004 Cooper
2006/0180002 A1 8/2006 Lin
2007/0277666 A1* 12/2007 Laukat ..... G10D 9/08 84/382
2016/0035327 A1* 2/2016 Allen ..... G10D 7/08 84/385 R
2019/0147839 A1 5/2019 Boyd

FOREIGN PATENT DOCUMENTS

TW M349534 U 1/2009

* cited by examiner

*Primary Examiner* — Kimberly R Lockett
(74) *Attorney, Agent, or Firm* — Rosenberg, Klein & Lee

(57) ABSTRACT

A saxophone has a body tube, a high-F #structure, and a side-Bb structure. The body tube has a high-F #tone hole and a side-Bb hole. The high-F #structure opens or closes the high-F #tone hole. The side-Bb structure has a side-Bb tone-hole cover, a side-Bb driving assembly, an auxiliary key, and a main key. The main key is separated from the auxiliary key. The auxiliary key is disposed above a high F #key of the high-F #structure along a vertical line. The auxiliary key and the main key are separately arranged around a centerline of the body tube. The auxiliary key and the main key correspond in height position. Both of the auxiliary key and the main key are connected to the side-Bb driving assembly and drive the side-Bb tone-hole cover to close or open the side-Bb tone hole.

7 Claims, 15 Drawing Sheets

SAXOPHONE HAVING AUXILIARY SIDE BB KEY

BACKGROUND OF THE INVENTION

1. Field of the Invention

The present invention relates to a musical instrument, especially to a saxophone.

2. Description of the Prior Arts

With reference to FIG. 11, to play high G note and notes above high G with a conventional saxophone, such as an alto saxophone or a tenor saxophone, altissimo fingerings have to be used. That is, to play high G and above, the right hand of a player may have to press a side-Bb key 92 and a high F #key 91 at the same time.

However, in the conventional saxophone, the side-Bb key 92 is deviated from the high F #key 91 along a vertical line, making fingering change from high F #to high G very difficult. As a result, notes played easily break up by mistake. Moreover, position of the side-Bb key 92 of the conventional saxophone also makes some high notes with staccato and notes with trill difficult to play.

With reference to FIG. 12, for example, to play high F #note, use the ring finger and the forefinger to press the high F #key 91 and a high-E key 93 respectively. With reference to FIG. 13, to play altissimo high G note, use the ring finger to press the high F #key 91, meanwhile use the second segment and/or the third segment of the middle finger to press the side-Bb key 92. However, when switching to altissimo high G, the middle finger needs to press the side-Bb key 92 in an unergonomic manner, and motion of right-hand-fingers is too much for the player to press the side-Bb key 92 at ease. As a result, notes played easily break up by mistake.

To overcome the shortcomings, the present invention provides a saxophone having an auxiliary side Bb key to mitigate or obviate the aforementioned problems.

SUMMARY OF THE INVENTION

The main objective of the present invention is to provide a saxophone having an auxiliary side Bb key for ease of playing.

The saxophone has a body tube, a high-F #structure and a side-Bb structure. The body tube extends upward and downward, and has a high-F #tone hole and a side-Bb tone hole. The high-F #structure is mounted on the body tube and has a high-F #tone-hole cover, a high-F #driving assembly, and a high F #key. The high-F #tone-hole cover selectively closes the high-F #tone hole of the body tube. The high-F #driving assembly is mounted on the body tube and connected to the high-F #tone-hole cover. The high F #key is connected to the high-F #driving assembly and drives the high-F #tone-hole cover to open or close the high-F #tone hole of the body tube. The side-Bb structure is mounted on the body tube and has a side-Bb tone-hole cover, a side-Bb driving assembly, an auxiliary key, and a main key. The side-Bb tone-hole cover is pivotally mounted on the body tube and selectively closes the side-Bb tone hole of the body tube. The side-Bb driving assembly is mounted on the body tube and connected to the side-Bb tone-hole cover. The auxiliary key is connected to the side-Bb driving assembly and drives the side-Bb tone-hole cover to close or open the side-Bb tone hole of the body tube. The auxiliary key is disposed above the high F #key of the high-F #structure along a vertical line. The main key is separated from the auxiliary key. The main key is connected to the side-Bb driving assembly and drives the side-Bb tone-hole cover to close or open the side-Bb tone hole of the body tube. The auxiliary key and the main key are separately arranged around a centerline of the body tube; the auxiliary key and the main key correspond in height position.

The advantage of the present invention is that the traditional side-Bb key is altered into an auxiliary key and a main key, and the auxiliary key is disposed above the high F #key while the main key is located substantially same as the traditional side-Bb key. As a result, a player can use either of the main key and the auxiliary key to open or close the side-Bb tone hole of body tube. Detailed advantages are as follows.

First, when switching from high F #note to altissimo high G note, the player may press the auxiliary key with a tip of the middle finger. As a result, fingering of switching notes is more ergonomic and motion of right-hand-fingers is reduced for ease of playing. In other words, the player can press the auxiliary key with ease, mitigating unintentional breaking up of notes when playing.

Second, when switching from altissimo high G note to high E note with staccato, the player may press the auxiliary key to reduce a distance that the right hand has to move, thereby keeping the sound continuous.

Third, when playing high F #note, altissimo high G note, and altissimo high G #note, the right hand may press the auxiliary key for better comfort and ease of playing.

Fourth, when playing high F #note and altissimo high G note with trill, the auxiliary key is capable of reducing motion of right-hand-fingers for ease of playing.

Fifth, the main key is positioned substantially same as the traditional side-Bb key such that the present invention is compatible with traditional saxophone fingerings.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
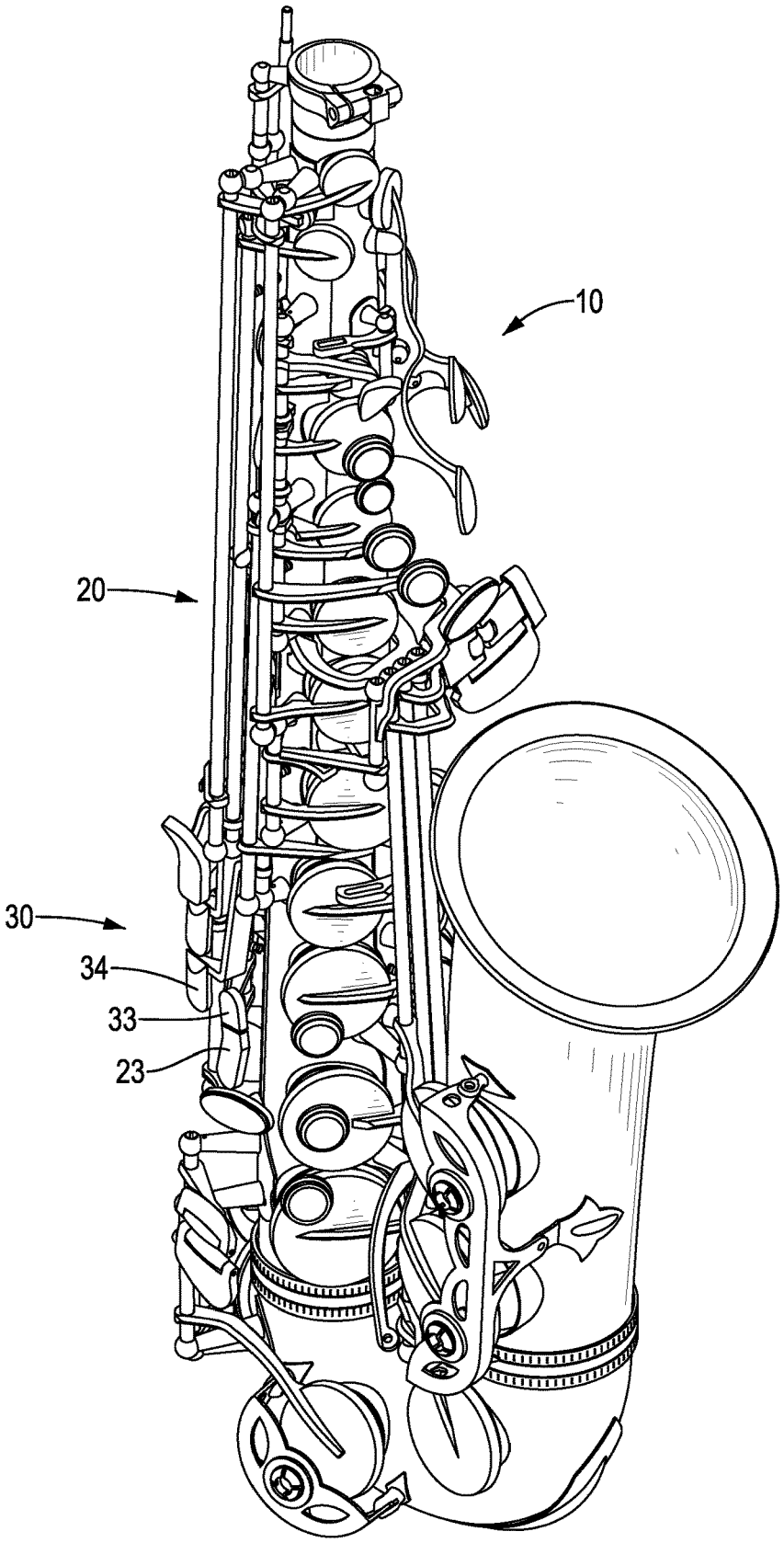
FIG. 1 is a perspective view of a saxophone in accordance with the present invention.
Figure 2A:
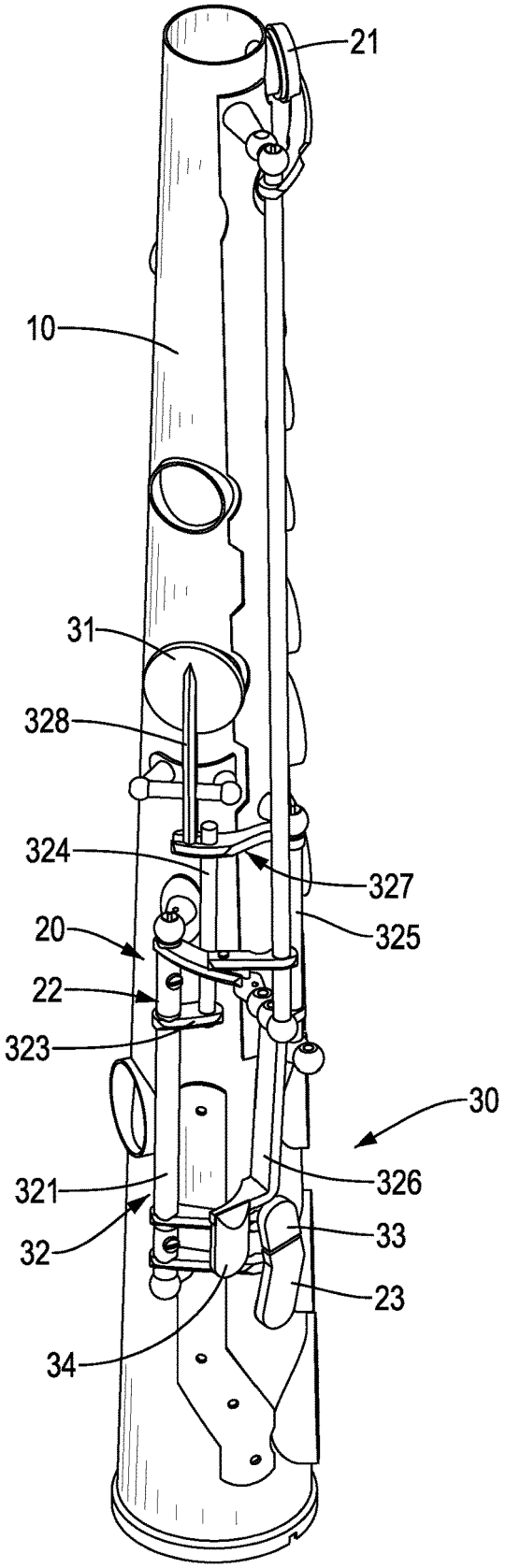
FIG. 2A is a perspective view of part of the saxophone in FIG. 1.
Figure 2B:
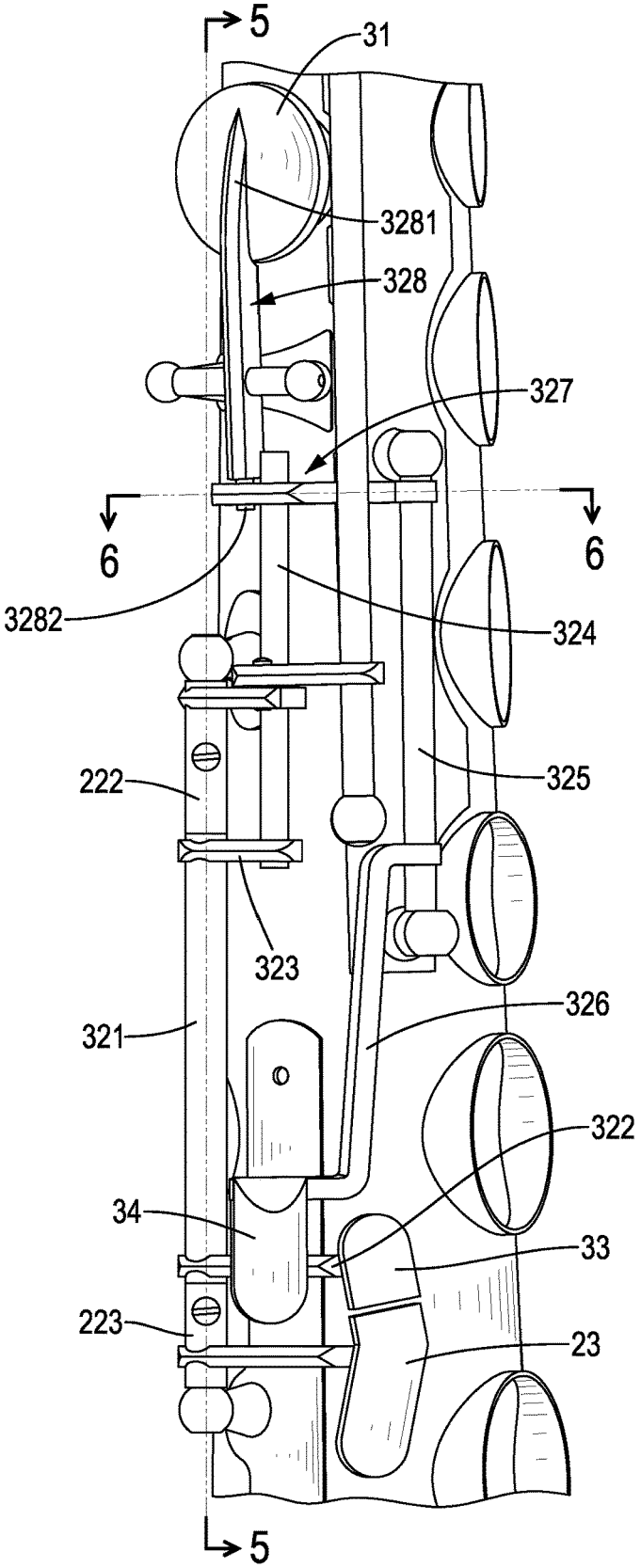
FIG. 2B is an enlarged side view of the saxophone in FIG. 2A.
Figure 2C:
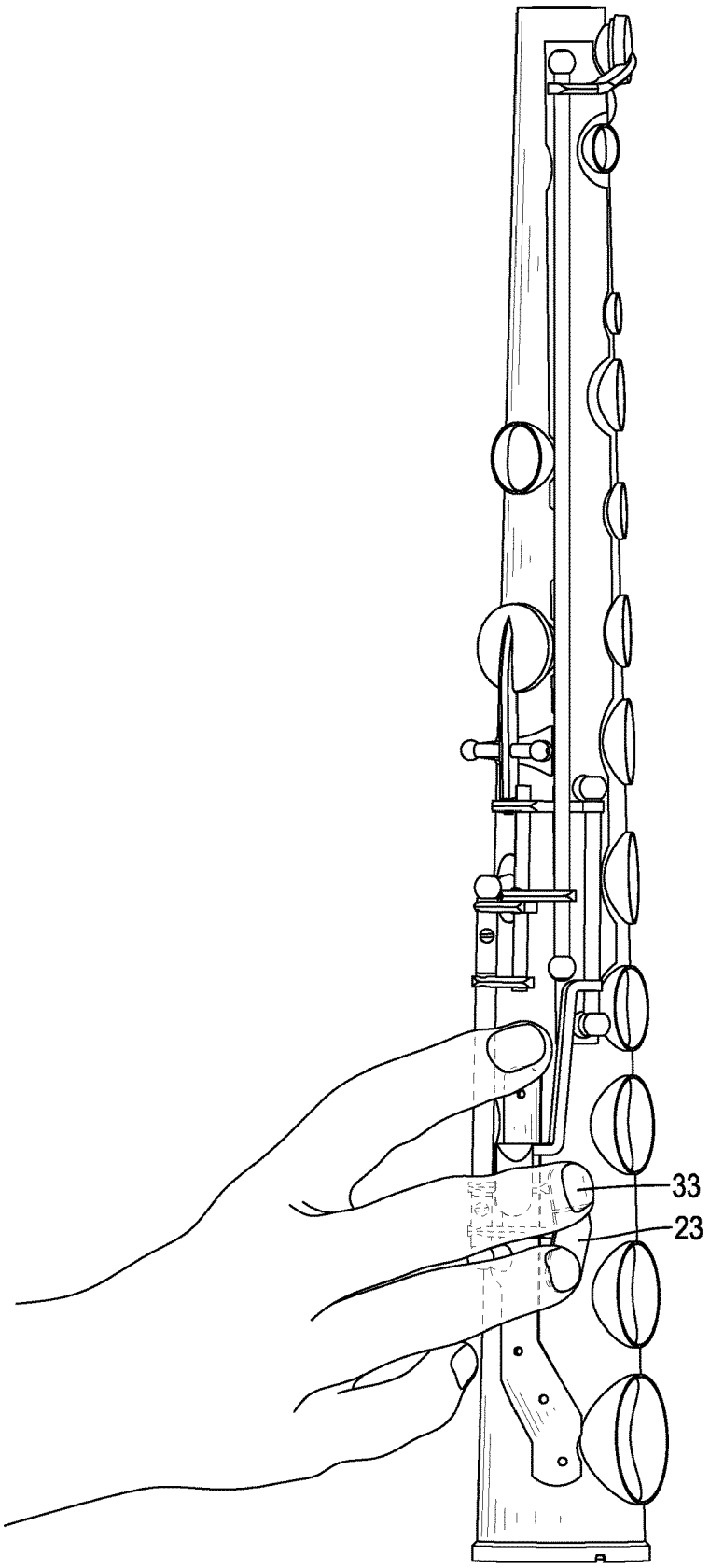
FIG. 2C is an operational perspective view of the saxophone in FIG. 2A, showing fingering for playing altissimo high G note.
Figure 3:
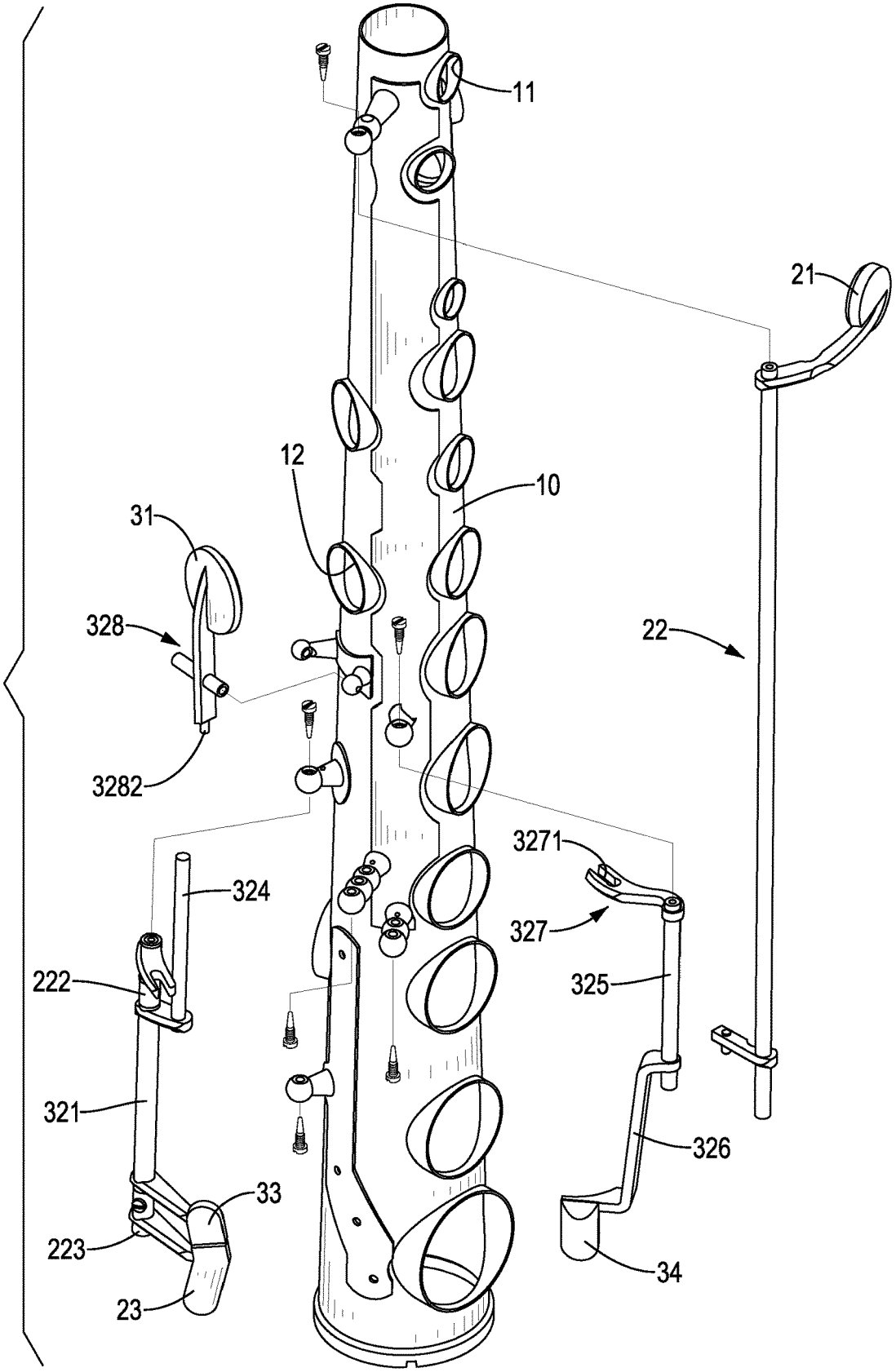
FIG. 3 is an exploded perspective view of the saxophone in FIG. 2A, showing high-F #structure and side-Bb structure.

With reference to FIGS. 1 to 3, a saxophone in accordance with the present invention is an alto saxophone or a tenor saxophone, and is an alto saxophone in the preferred embodiment. The saxophone comprises a body tube 10, a high-F #structure 20, a side-Bb structure 30, and multiple tone-hole controlling structures.

The body tube 10 extends upward and downward, and has a high-F #tone hole 11, a side-Bb tone hole 12, and multiple other tone holes. The high-F #structure 20, the side-Bb structure 30, and the multiple tone-hole controlling structures are used for controlling opening and closing of the tone holes of the body tube 10.

The high-F #structure 20 controls opening and closing of the high-F #tone hole 11. The high-F #structure 20 is mounted on the body tube 10 and has a high-F #tone-hole cover 21, a high-F #driving assembly 22, and a high-F key 23. The high-F #tone-hole cover 21 is pivotally mounted on the body tube 10 and selectively closes the high-F #tone hole 11 of the body tube 10.

Figure 4:
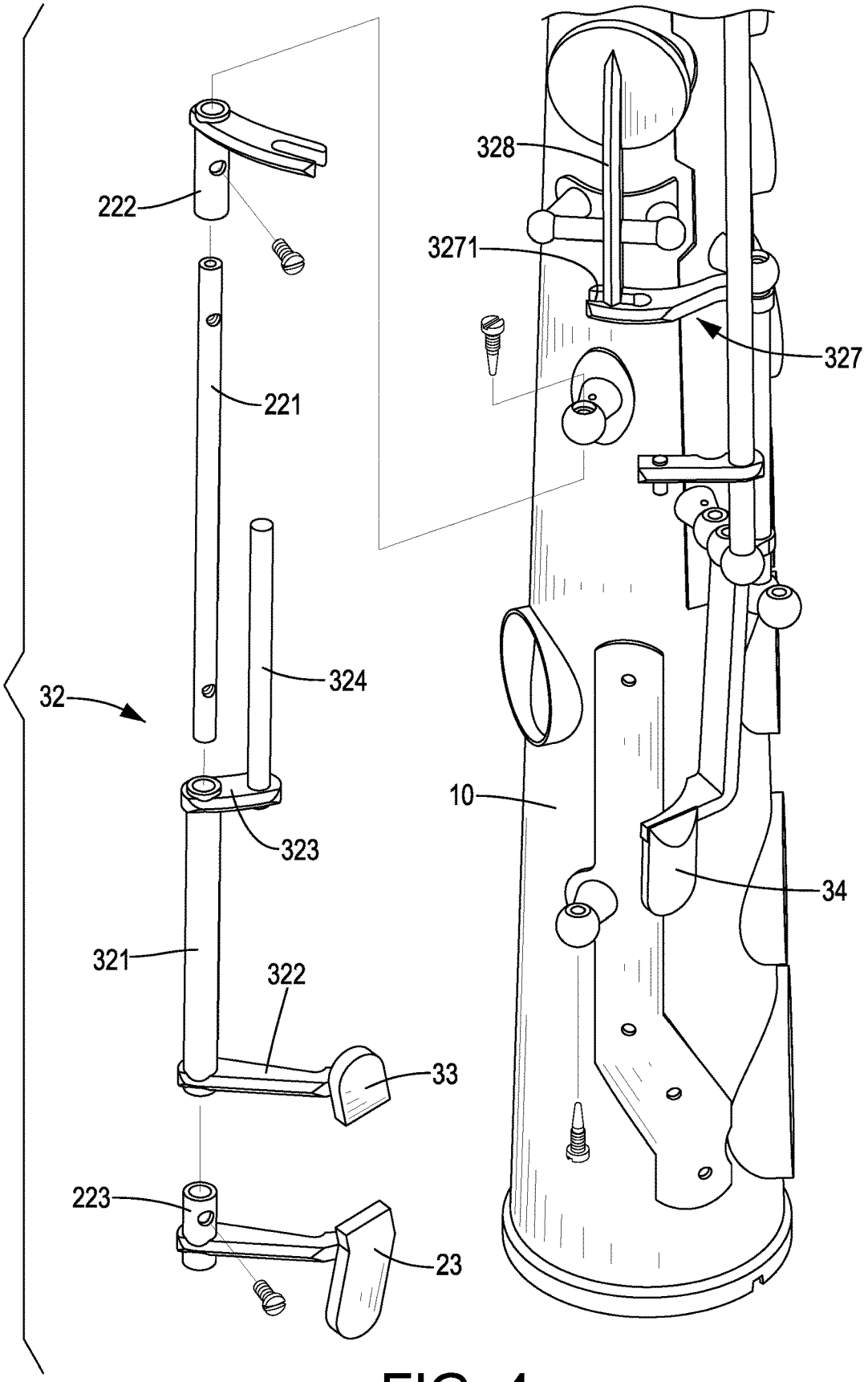
FIG. 4 is an enlarged exploded perspective view of the saxophone in FIG. 2A, showing dissembled side-Bb structure.
Figure 5:
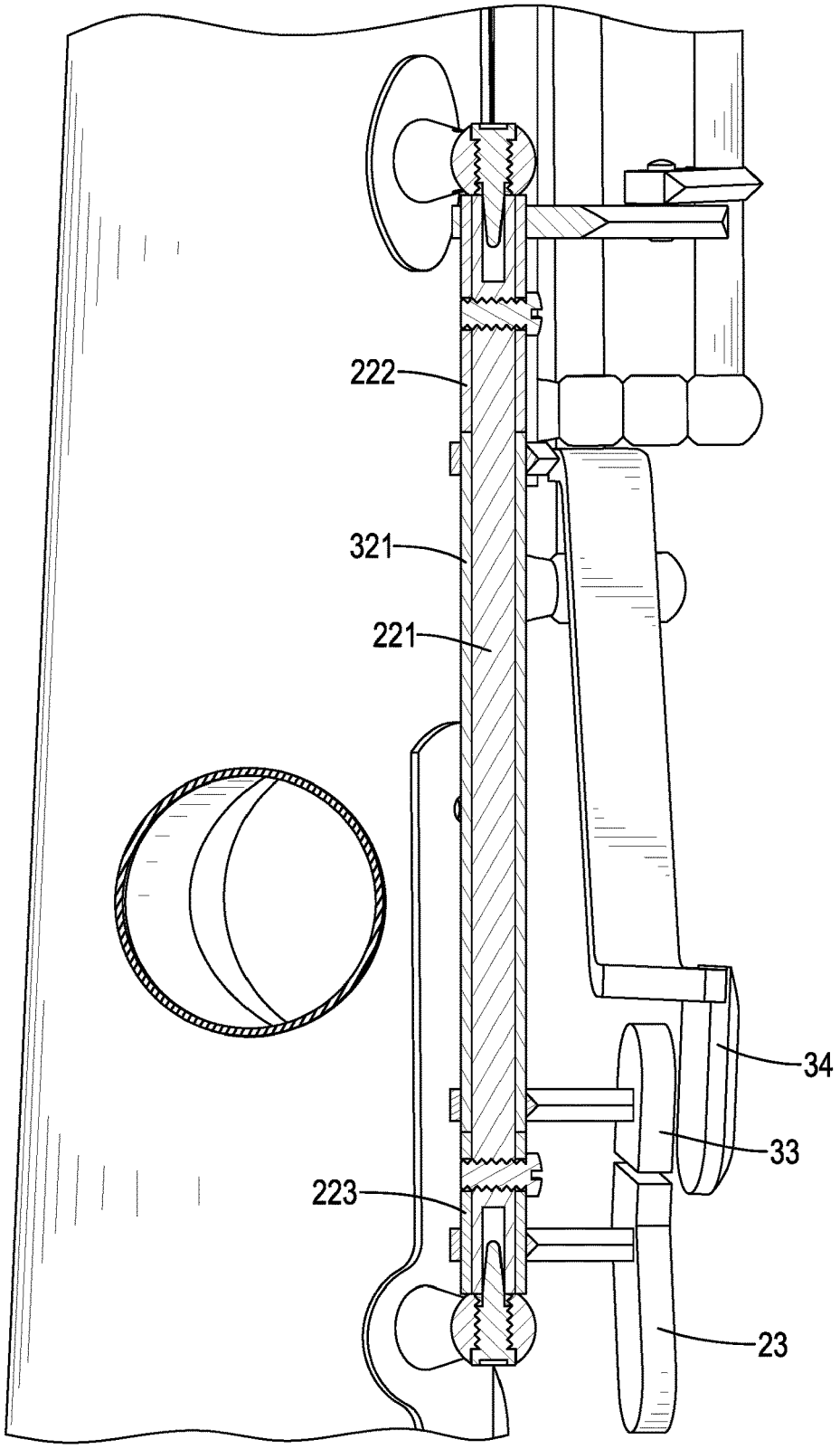
FIG. 5 is an enlarged sectional view of the saxophone along line 5-5 in FIG. 2B.
Figure 7:
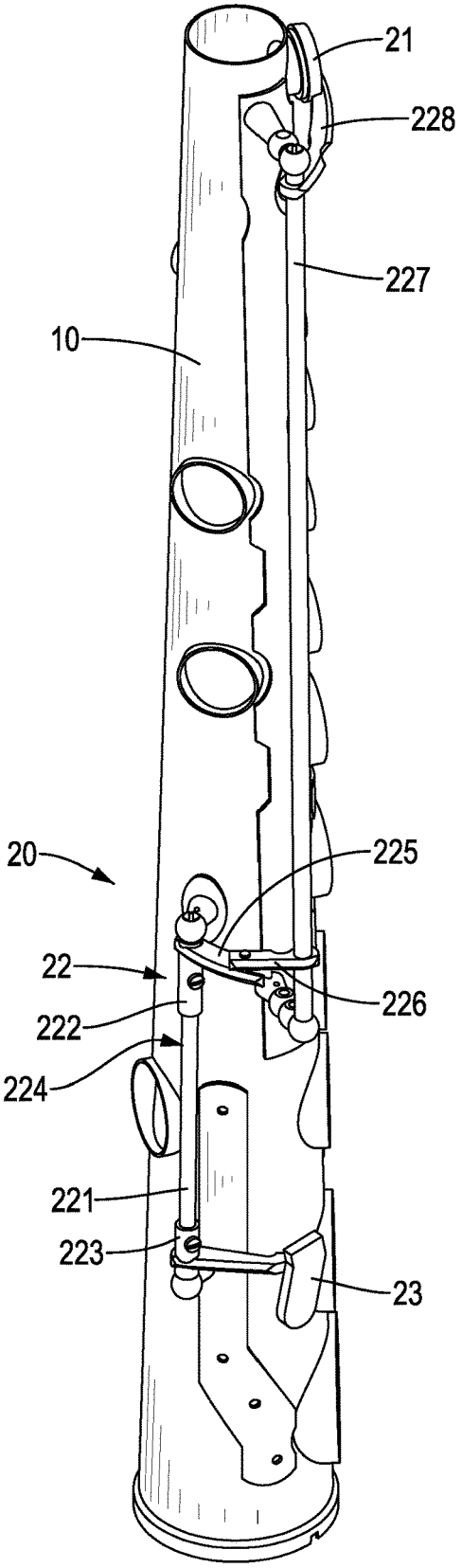
FIGS. 7 and 8 are operational perspective views of the saxophone in FIG. 2A, showing different operating statuses of the high-F #structure.

With reference to FIGS. 4, 5 and 7, the high-F #driving assembly 22 is mounted on the body tube 10 and connected to the high-F #tone-hole cover 21. In the preferred embodiment, the high-F #driving assembly 22 has a high-F #-driving rod 221, an upper connecting sleeve 222, and a lower connecting sleeve 223.

The high-F #-driving rod 221 extends upward and downward, and is rotatably mounted on the body tube 10. The upper connecting sleeve 222 is detachably located around a top end of the high-F #-driving rod 221. The lower connecting sleeve 223 is detachably located around a bottom end of the high-F #-driving rod 221. The upper connecting sleeve 222 and the lower connecting sleeve 223 form a mounting groove 224 (as shown in FIG. 7) on an outer surface of the high-F #-driving rod 221.

The high-F key 23 is preferably a plate connected to the lower connecting sleeve 223 of the high-F #driving assembly 22 via a connecting rod. The high-F key 23 drives the high-F #tone-hole cover 21 to open or close the high-F #tone hole 11 of the body tube 10. To be precise, when high-F key 23 is not pressed by player, a resilient element (not shown in figures) of the high-F #driving assembly 22 drives the high-F #tone-hole cover 21 to close the high-F #tone hole 11.

Figure 8:
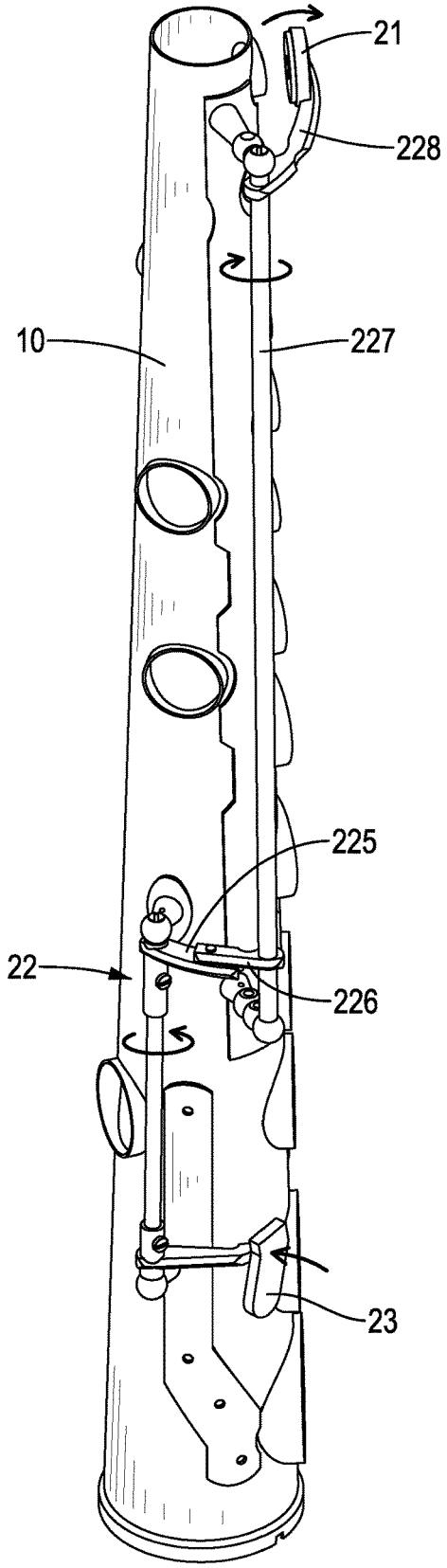

With reference to FIGS. 3, 7, and 8, when the player presses the high-F key 23, the high-F #-driving rod 221 is driven by the high-F key 23 to rotate, thereby driving the high-F #tone-hole cover 21 via other mechanisms of the high-F #driving assembly 22 to open the high-F #tone hole 11.

In the preferred embodiment, the high-F #driving assembly 22 has a first rocker 225, a second rocker 226, a connecting rod 227, and a high-F #-cover rod 228. The first rocker 225 and the second rocker 226 are disposed between the upper connecting sleeve 222 and the connecting rod 227. The first rocker 225 is fixed to a top end of the upper connecting sleeve 222. The second rocker 226 is fixed to a bottom end of the connecting rod 227. The first rocker 225 and the second rocker 226 are pivotally connected to each other. The high-F #-cover rod 228 is fixed between a top end of the connecting rod 227 and the high-F #tone-hole cover 21.

When the high-F key 23 is pressed, the high-F #-driving rod 221 is driven by the high-F key 23 to rotate, which in turn rotates the upper connecting sleeve 222, the first rocker 225, the second rocker 226, the connecting rod 227, and the high-F #-cover rod 228 to drive the high-F #tone-hole cover 21 to open the high-F #tone hole 11.

With reference to FIGS. 3 to 5 and 9, the side-Bb structure 30 controls opening and closing of the side-Bb tone hole 12. The side-Bb structure 30 is mounted on the body tube 10 and has a side-Bb tone-hole cover 31, a side-Bb driving assembly 32, an auxiliary key 33, and a main key 34. The side-Bb tone-hole cover 31 is pivotally mounted on the body tube 10 and selectively closes the side-Bb tone hole 12 of the body tube 10.

With reference to FIG. 3 and FIG. 4, the side-Bb driving assembly 32 is mounted on the body tube 10 and connected to the side-Bb tone-hole cover 31. In the preferred embodiment, the side-Bb driving assembly 32 has a driving sleeve 321, an auxiliary-key connecting rod 322, an auxiliary-key rocker 323, an auxiliary-key driving rod 324, a main-key driving rod 325, a main-key connecting rod 326, a main-key rocker 327, and a side-Bb-cover rod 328.

With reference to FIG. 2B and FIG. 3, the side-Bb-cover rod 328 is pivotally mounted on the body tube 10. Two opposite ends of the side-Bb-cover rod 328 are respectively defined as a first end 3281 and a second end 3282. The first end 3281 is connected to the side-Bb tone-hole cover 31. Rotation of the side-Bb-cover rod 328 drives the side-Bb tone-hole cover 31 to close or open the side-Bb tone hole 12 of the body tube 10.

With reference to FIGS. 4, 5, and 7, the driving sleeve 321 is rotatably mounted around the high-F #-driving rod 221 of the high-F #structure 20. To be specific, the driving sleeve 321 is rotatably mounted in the mounting groove 224 (as shown in FIG. 7) formed between the upper connecting sleeve 222 and the lower connecting sleeve 223. A lubricant layer (not shown in figures) is disposed between the driving sleeve 321 and the high-F #-driving rod 221 to prevent interference of rotation between the driving sleeve 321 and the high-F #-driving rod 221. Said lubricant layer is preferably formed by applying lubricating oil on the high-F #-driving rod 221.

With reference to FIG. 4, one of two opposite ends of the auxiliary-key connecting rod 322 is connected to the driving sleeve 321, and the other one of said two opposite ends of the auxiliary-key connecting rod 322 is connected to the auxiliary key 33. The auxiliary-key connecting rod 322 extends along a radial direction of the driving sleeve 321. The auxiliary-key rocker 323 is mounted on a top end of the driving sleeve 321 and extends along the radial direction of the driving sleeve 321. The auxiliary-key driving rod 324 extends upward and downward. A bottom end of the auxiliary-key driving rod 324 is fixed to the auxiliary-key rocker 323.

With reference to FIG. 2B and FIG. 3, the main-key driving rod 325 extends upward and downward, and is rotatably mounted on the body tube 10. The main-key connecting rod 326 is z-shaped. One of two opposite ends of the main-key connecting rod 326 is connected to the main-key driving rod 325, and the other one of said two opposite ends is connected to the main key 34. The main-key rocker 327 is mounted on the main-key driving rod 325 and extends along a radial direction of the main-key driving rod 325.

Figure 6:
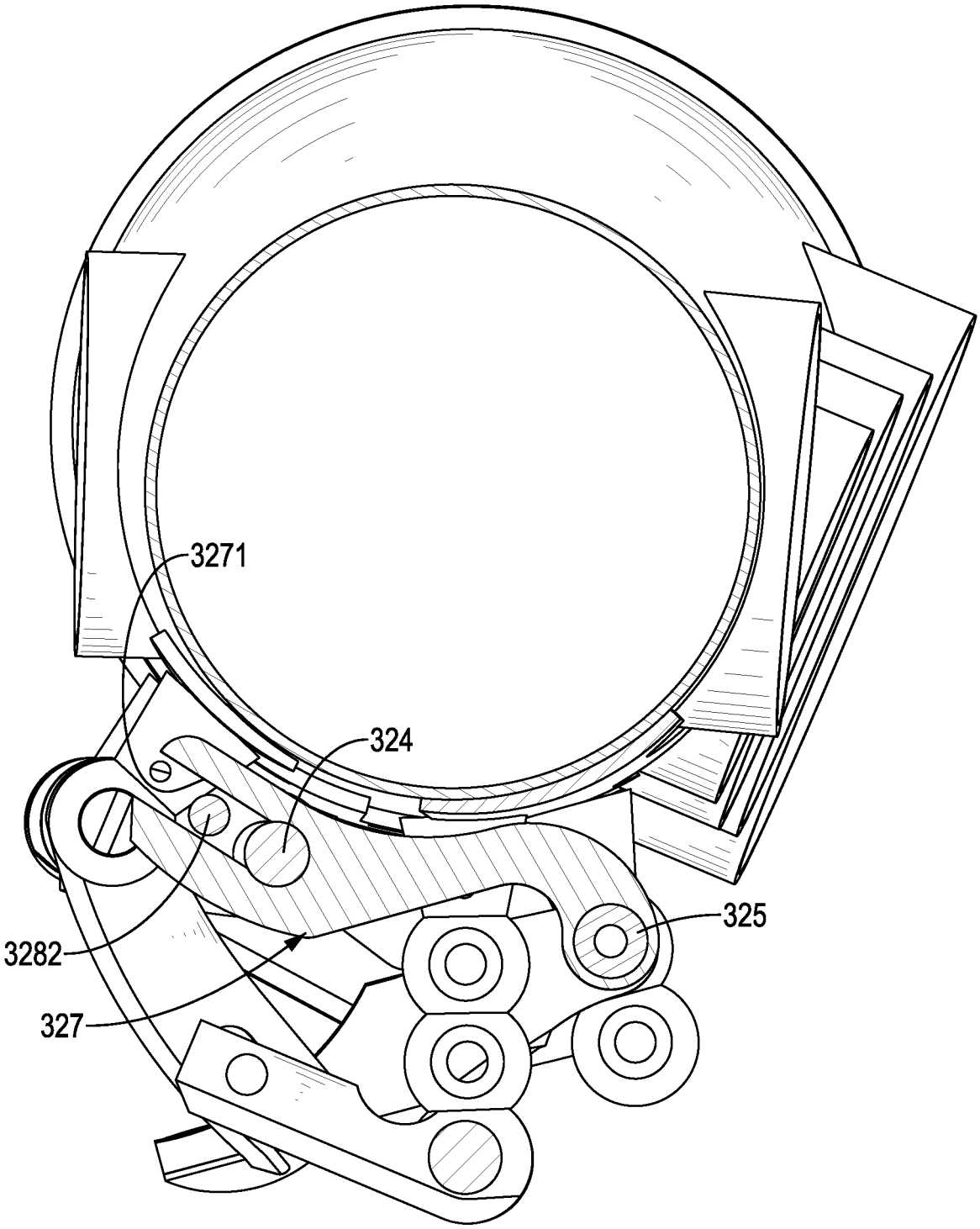
FIG. 6 is a sectional view of the saxophone along line 6-6 in FIG. 2B.

With reference to FIG. 6, a connecting slot 3271 is formed in a distal end of the main-key rocker 327. The main-key rocker 327 is slidably located around the second end 3282 of the side-Bb-cover rod 328 via the connecting slot 3271. When the main-key driving rod 325 is rotated, the main-key rocker 327 drives the side-Bb-cover rod 328 to pivot, thereby closing or opening the side-Bb tone hole 12 of the body tube 10.

Figure 9:
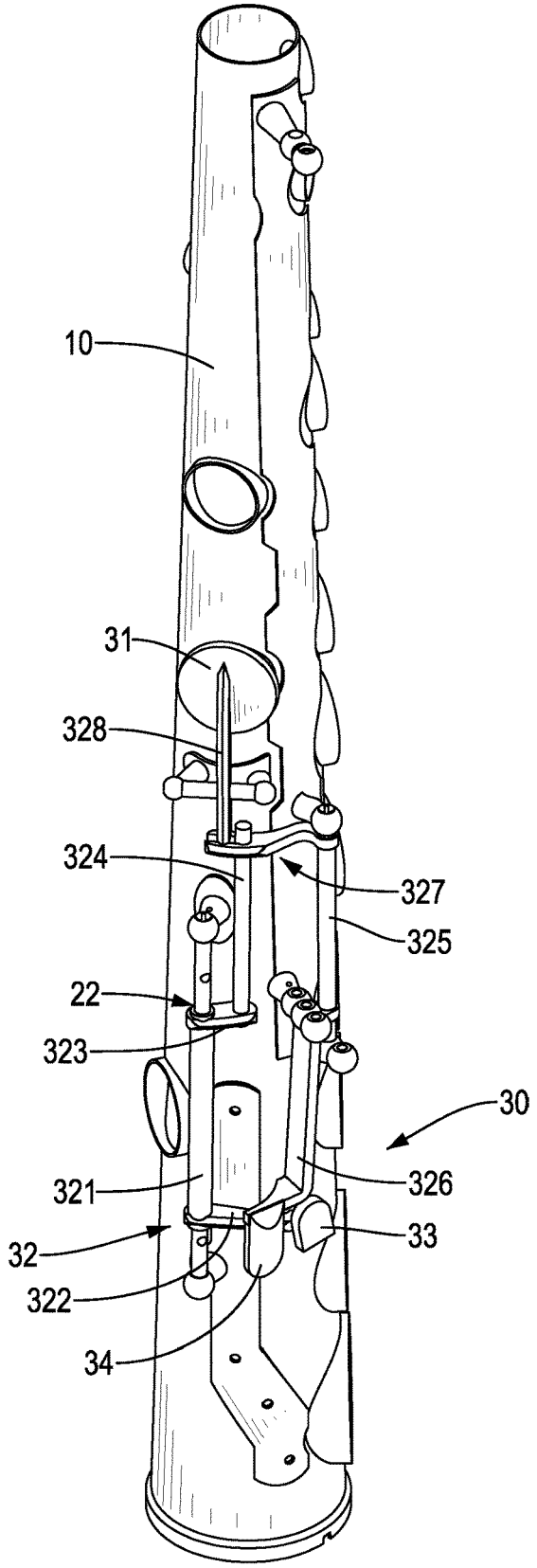
FIGS. 9 and 10 are operational perspective views of the saxophone in FIG. 2A, showing different operating statuses of the side-Bb structure.

With reference to FIGS. 4, 5, and 9, a top end of the auxiliary-key driving rod 324 is rotatably mounted in the connecting slot 3271 of the main-key rocker 327 such that the driving sleeve 321 is connected to the main-key driving rod 325 via the auxiliary-key rocker 323, the auxiliary-key driving rod 324, and the main-key rocker 327. Therefore, rotation of the driving sleeve 321 drives the main-key driving rod 325 to rotate, and rotation of the main-key driving rod 325 also drives the driving sleeve 321 to rotate.

The tone-hole controlling structures each control opening and closing of a respective one of the tone holes except for the high-F #tone hole 11 and the side-Bb tone hole 12. Each tone-hole controlling structure has a tone key, multiple rods, and a tone-hole cover. When the player presses the tone key, the rods are rotated such that the tone-hole cover opens or closes the respective tone hole. The tone-hole controlling structures are substantially same as tone-hole controlling structures in a traditional saxophone.

With reference to FIGS. 2B, 3, and 4, the auxiliary key 33 is preferably a plate connected to the side-Bb driving assembly 32 via the auxiliary-key connecting rod 322. The auxiliary key 33 drives the side-Bb tone-hole cover 31 to open or close the side-Bb tone hole 12 of the body tube 10. The auxiliary key 33 is disposed above the high F #key 23 of the high-F #structure 20 along a vertical line.

With reference to FIG. 2C, to play altissimo high G note, the player may press the auxiliary key 33 with the first segment of middle finger, and meanwhile presses the high-F key 23 with the first segment of ring finger. As a result, fingering for playing altissimo high G note is ergonomic and easy to operate.

With reference to FIG. 3, the main key 34 is separated from the auxiliary key 33 and is preferably a plate. The main key 34 drives the side-Bb tone-hole cover 31 to open or close the side-Bb tone hole 12 of the body tube 10 via the side-Bb driving assembly 32. To be specific, the main key 34 is connected to the main-key connecting rod 326 of the side-Bb driving assembly 32 to drive the side-Bb tone-hole cover 31 to open or close the side-Bb tone hole 12.

With reference to FIG. 2A and FIG. 2B, the auxiliary key 33 and the main key 34 are separately arranged around a centerline of the body tube 10; that is, when viewed laterally (as shown in FIG. 2B), the auxiliary key 33 and the main key 34 are disposed apart from each other along the horizontal direction.

The auxiliary key 33 and the main key 34 correspond in height position; that is, the auxiliary key 33 and the main key 34 are substantially same in height position, but height position of the auxiliary key 33 can slightly deviate from the main key 34. The main key 34 is positioned substantially same as the traditional side-Bb key such that the present invention is compatible with traditional saxophone fingerings.

Figure 10:
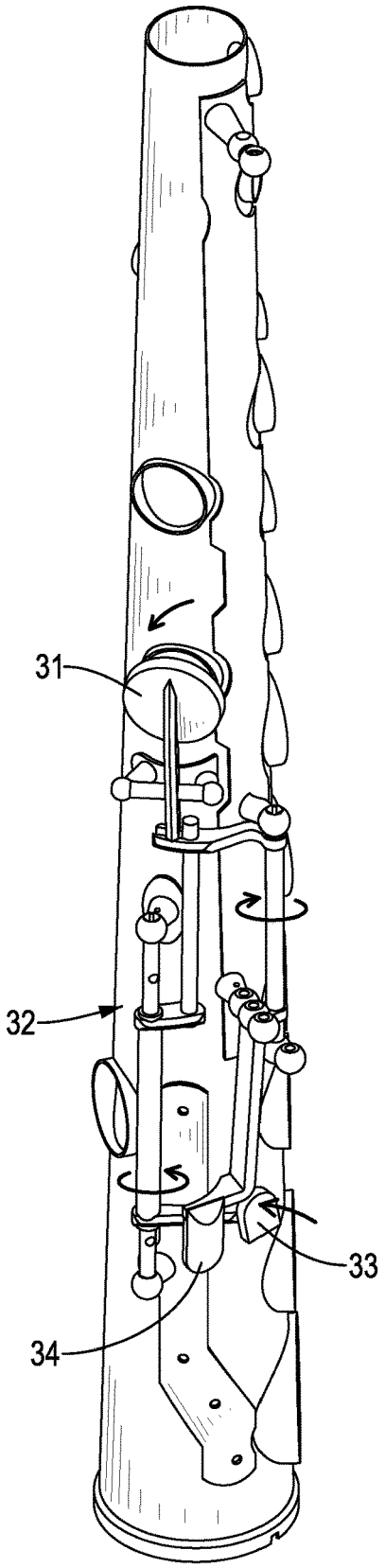
Figure 11:
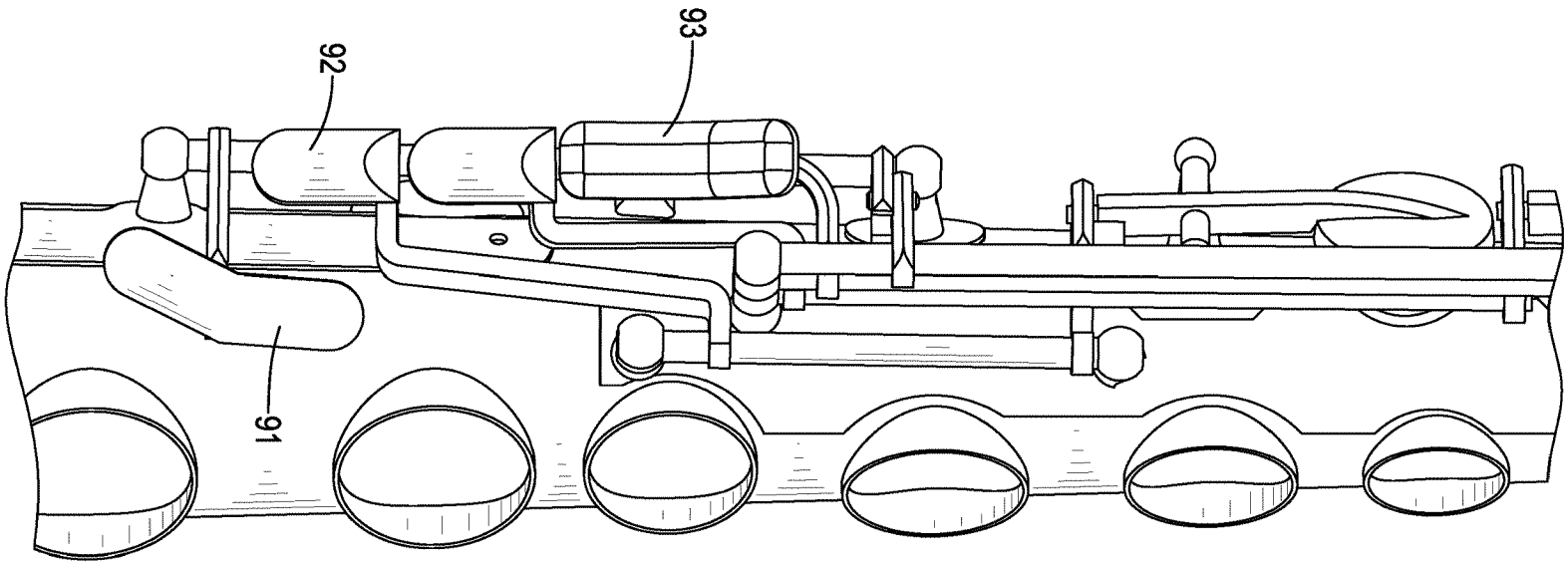
FIG. 11 PRIOR ART
FIG. 11 is an enlarged side view of a conventional saxophone in accordance with the prior art.
Figure 12:
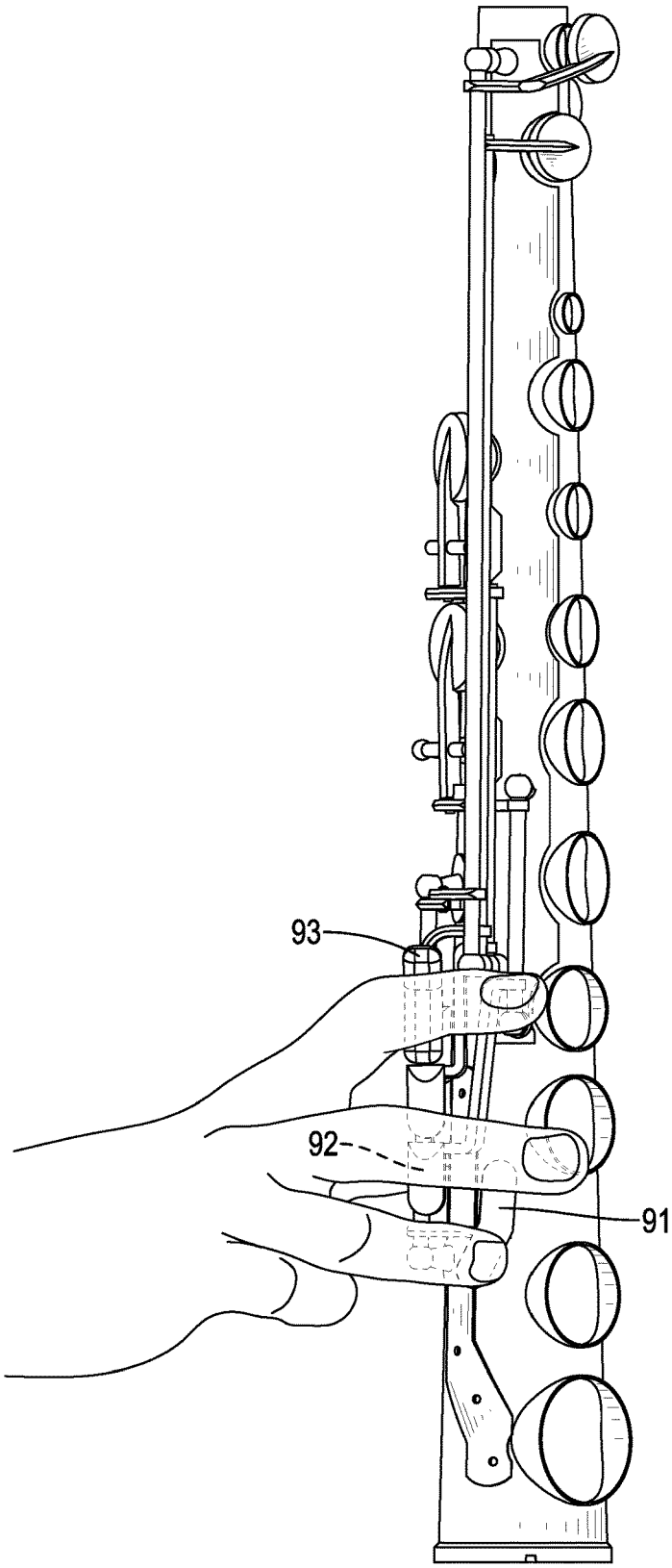
FIG. 12 PRIOR ART
FIGS. 12 and 13 are operational side views of the conventional saxophone in FIG. 11, showing different operating statuses of the conventional saxophone.
Figure 13:
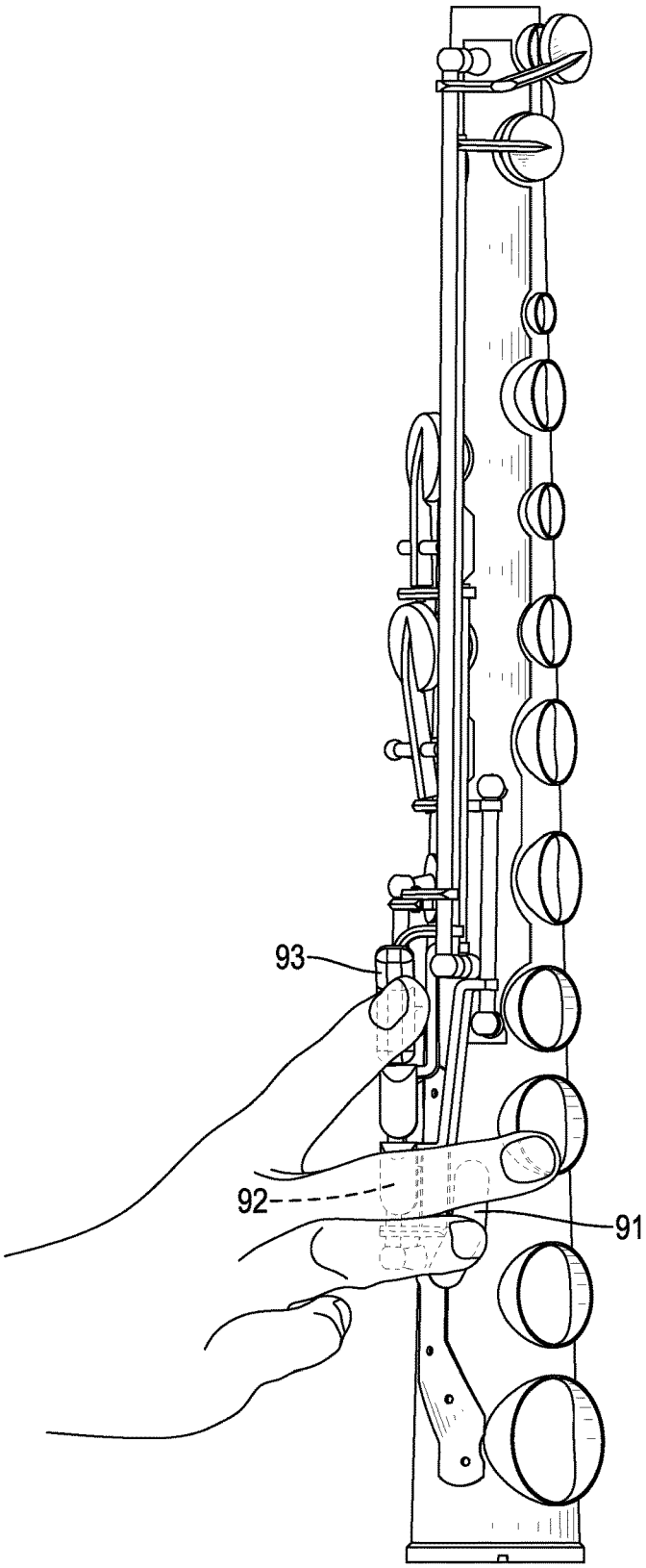
FIG. 13 PRIOR ART

With reference to FIG. 9 and FIG. 10, when playing the saxophone, the side-Bb tone-hole cover 31 can be controlled by either of the auxiliary key 33 and the main key 34 to open or close the side-Bb tone hole 12 via the side-Bb tone-hole cover 31. With reference to FIG. 2C, when playing altissimo high G note, the player may press the auxiliary key 33 with the first segment of middle finger (not yet pressed in FIG. 2C), and meanwhile presses the high-F key 23 with the first segment of ring finger. As a result, right-hand-fingering is more ergonomic. Moreover, motion of right-hand-fingers when switching notes is reduced for ease of playing.

In summary, by designing an auxiliary key 33 and a main key 34 in the side-Bb structure 30, disposing the auxiliary key 33 above the high F #key 23, and disposing the main key 34 substantially same as the traditional side-Bb key, the present invention has the following advantages.

First, when switching from high F #note to altissimo high G note, the player may press the auxiliary key 33 with the tip of middle finger to control the side-Bb tone hole 12. As a result, fingering of switching notes is more ergonomic and motion of right-hand-fingers is reduced for ease of playing. In other words, the player can press the auxiliary key with ease, mitigating unintentional breaking up of notes when playing.

Second, when switching from altissimo high G note to high E note with staccato, unintentional gap of sound can be avoided.

Third, when playing high F #note, altissimo high G note, and altissimo high G #note, the right hand may press the auxiliary key 33 for better comfort and ease of playing.

Fourth, when playing high F #note and altissimo high G note with trill, the auxiliary key 33 is capable of reducing motion of right-hand-fingers for ease of playing.

Fifth, the main key 34 is positioned substantially same as the traditional side-Bb key such that the present invention is compatible with traditional saxophone fingerings.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A saxophone, being an alto saxophone or a tenor saxophone, the saxophone comprising:

a body tube extending upward and downward, and having
a high-F #tone hole; and
a side-Bb tone hole;

a high-F #structure mounted on the body tube and having
a high-F #tone-hole cover selectively closing the high-F #tone hole of the body tube;
a high-F #driving assembly mounted on the body tube and connected to the high-F #tone-hole cover; and
a high F #key connected to the high-F #driving assembly and driving the high-F #tone-hole cover to open or close the high-F #tone hole of the body tube;

a side-Bb structure mounted on the body tube and having
a side-Bb tone-hole cover pivotally mounted on the body tube and selectively closing the side-Bb tone hole of the body tube;
a side-Bb driving assembly mounted on the body tube and connected to the side-Bb tone-hole cover;
an auxiliary key connected to the side-Bb driving assembly and driving the side-Bb tone-hole cover to close or open the side-Bb tone hole of the body tube; the auxiliary key disposed above the high F #key of the high-F #structure along a vertical line; and a main key separated from the auxiliary key; the main key connected to the side-Bb driving assembly and driving the side-Bb tone-hole cover to close or open the side-Bb tone hole of the body tube;

wherein the auxiliary key and the main key are separately arranged around a centerline of the body tube; the auxiliary key and the main key correspond in height position.

2. The saxophone as claimed in claim 1, wherein the high-F #driving assembly of the high-F #structure has a high-F #-driving rod extending upward and downward, and rotatably mounted on the body tube; and the side-Bb driving assembly of the side-Bb structure has a driving sleeve rotatably located around the high-F #-driving rod; and an auxiliary-key connecting rod; one of two opposite ends of the auxiliary-key connecting rod connected to the driving sleeve; the other one of said two opposite ends of the auxiliary-key connecting rod connected to the auxiliary key; the auxiliary-key connecting rod extending along a radial direction of the driving sleeve.

3. The saxophone as claimed in claim 2, wherein the side-Bb driving assembly of the side-Bb structure has a main-key driving rod extending upward and downward, and rotatably mounted on the body tube; and a main-key connecting rod; one of two opposite ends of the main-key connecting rod connected to the main-key driving rod; the other one of said two opposite ends of the main-key connecting rod connected to the main key;

wherein the driving sleeve is indirectly connected to the main-key driving rod such that rotation of the driving sleeve drives the main-key driving rod to rotate.

4. The saxophone as claimed in claim 3, wherein the side-Bb driving assembly of the side-Bb structure has a side-Bb-cover rod pivotally connected to the body tube; two opposite ends of the side-Bb-cover rod respectively defined as a first end and a second end; the first end connected to the side-Bb tone-hole cover; rotation of the side-Bb-cover rod driving the side-Bb tone-hole cover to close or open the side-Bb tone hole of the body tube;

a main-key rocker mounted on the main-key driving rod and extending along a radial direction of the main-key driving rod; a distal end of the main-key rocker located around the second end of the side-Bb-cover rod; wherein when the main-key driving rod is rotated, the main-key rocker drives the side-Bb-cover rod to rotate to close or open the side-Bb tone hole of the body tube;

an auxiliary-key rocker mounted on a top end of the driving sleeve and extending along a radial direction of the driving sleeve; and an auxiliary-key driving rod extending upward and downward; a bottom end of the auxiliary-key driving rod fixed to the auxiliary-key rocker; a top end of the auxiliary-key driving rod rotatably mounted in the distal end of the main-key rocker.

5. The saxophone as claimed in claim 2, wherein the high-F #driving assembly of the high-F #structure has an upper connecting sleeve detachably located around a top end of the high-F #-driving rod; and a lower connecting sleeve detachably located around a bottom end of the high-F #-driving rod; and the driving sleeve of the side-Bb structure is mounted between the upper connecting sleeve and the lower connecting sleeve.

6. The saxophone as claimed in claim 3, wherein the high-F #driving assembly of the high-F #structure has an upper connecting sleeve detachably located around a top end of the high-F #-driving rod; and a lower connecting sleeve detachably located around a bottom end of the high-F #-driving rod; and the driving sleeve of the side-Bb structure is mounted between the upper connecting sleeve and the lower connecting sleeve.

7. The saxophone as claimed in claim 4, wherein the high-F #driving assembly of the high-F #structure has an upper connecting sleeve detachably located around a top end of the high-F #-driving rod; and a lower connecting sleeve detachably located around a bottom end of the high-F #-driving rod; and the driving sleeve of the side-Bb structure is mounted between the upper connecting sleeve and the lower connecting sleeve.

* * * * *